US009498038B2

(12) United States Patent
McLaughlin

(10) Patent No.: US 9,498,038 B2
(45) Date of Patent: Nov. 22, 2016

(54) HANDBAG PROTECTION DEVICE

(71) Applicant: Jamie McLaughlin, Chicago, IL (US)

(72) Inventor: Jamie McLaughlin, Chicago, IL (US)

(73) Assignee: Three Pearls LLC, Chicago, IL (US)

( * ) Notice: Subject to any disclaimer, the term of this patent is extended or adjusted under 35 U.S.C. 154(b) by 710 days.

(21) Appl. No.: 13/633,510

(22) Filed: Oct. 2, 2012

(65) Prior Publication Data

US 2013/0081742 A1 Apr. 4, 2013

Related U.S. Application Data

(60) Provisional application No. 61/542,596, filed on Oct. 3, 2011.

(51) Int. Cl.
*A45C 13/00* (2006.01)

(52) U.S. Cl.
CPC ..... *A45C 13/002* (2013.01)

(58) Field of Classification Search
CPC .... B65D 81/3886; B65D 25/34; A61G 5/10; B62D 1/06; E04G 21/30
USPC ..... 150/154–168; 206/544; 383/127; D3/318, 319
See application file for complete search history.

(56) References Cited

U.S. PATENT DOCUMENTS

| | | | | |
|---|---|---|---|---|
| 4,112,991 | A * | 9/1978 | Barbaresi | A45C 13/00 150/104 |
| 4,907,633 | A * | 3/1990 | Eckstein | A45C 3/08 150/105 |
| 5,009,319 | A * | 4/1991 | Jantzen | 206/544 |
| 6,769,807 | B2 | 8/2004 | Bayard | |
| 7,108,425 | B2 | 9/2006 | Temkin | |
| 2011/0101043 | A1 | 5/2011 | Jelks | |
| 2011/0240691 | A1 | 10/2011 | Miller | |
| 2011/0284563 | A1 | 11/2011 | Henderson | |
| 2012/0055959 | A1 | 3/2012 | Hale et al. | |

* cited by examiner

*Primary Examiner* — Fenn Mathew
*Assistant Examiner* — Cynthia Collado
(74) *Attorney, Agent, or Firm* — Zane Coleman

(57) ABSTRACT

In one embodiment, a handbag protection device includes a base region to facilitate the retention of shape of the protected handbag and one or more flap extension(s) to facilitate the separation of one or more cover(s), flap(s), or other enclosure(s) of the handbag from the body or one or more other part(s) or component(s) of the handbag. The handbag protection device may include one or more attached, unattached, detachable, or other operatively coupled support extension(s) that enclose(s), partially enclose(s), or wrap(s) around or cover(s) any chain(s), strap(s), handle(s), decoration(s) or other part(s) or component(s) of the handbag that can be used for carrying, hanging, ornamentation or other purposes.

19 Claims, 8 Drawing Sheets

HANDBAG PROTECTION DEVICE

CROSS REFERENCE TO RELATED APPLICATIONS

This application claims the benefit of U.S. Provisional Application No. 61/542,596, entitled "Handbag Protection Device," filed Oct. 3, 2011, the entire contents of which are incorporated herein by reference.

FIELD OF THE INVENTION

This invention generally relates to devices for the improvement, protection, organization or preservation of transportation containers such as handbags, purses, pocketbooks, attaché cases, briefcases, and other carrying bags or luggage.

BACKGROUND OF THE INVENTION

There is a problem relating to the preservation of handbags. Handbags come in many designs, and certain designs are more susceptible to damage from certain conditions, including conditions during storage or transport. Some users of handbags prefer that the condition and shape of their handbags be preserved. For example, some users of handbags would prefer that a handbag retain the shape it had when it was newly purchased, or at least a shape that is as close to that original shape as possible, and some users would prefer to avoid or minimize dimples, impressions, wrinkles, sticking, color transfer and other changes that in their view reduce or may reduce the value or enjoyment of a handbag.

Some users store handbags for long periods of time between use. For example, some users would carry a handbag in the summer, but would deem it not appropriate for the winter because of its color or design; other users might deem certain handbags to be appropriate for a more formal event, but not appropriate for casual everyday use. Some handbags, when stored for long periods of time can change, sag, collapse, wrinkle, dimple or otherwise change shape during storage or transport. There are many other reasons a handbag may transported or be placed in shorter- or longer-term storage.

Some handbags have metal or other hard components or chains which can scratch, abrade, or cause indentation or other damage to more delicate materials, such as leather or other animal skin, fabric, patent leather, vinyl or other synthetic materials.

Some users of handbags are passionate about preserving and maintaining the shape and condition of their handbags. Some users of handbags intend to resell handbags in a secondary or auction market and want to care for a handbag so that the resale value of the handbag might be enhanced as compared to a similar handbag that was not similarly cared for.

This problem is recognized in the field and there have been earlier attempts to provide protection for handbags. For example, some manufacturers of handbags stuff handbags with tissue paper, felt or plastic for transportation and storage prior to initial sale and may wrap the exterior of a handbag with tissue paper or plastic. Some users of handbags carefully preserve these materials for storage, but they can be inconvenient to use, are not visually appealing to certain users and may have inferior protection characteristics. Other manufacturers of handbags, particularly those that sell at higher prices, commonly sell their handbags with a protective box, may also include a dust cover or dust bag with which to cover or in which to enclose the handbag, with such dust cover or dust bag frequently made of felt or other fabric, and may also include protective pieces of felt or other fabric intended to protect particular components of a handbag, such as metal components or other so-called "hardware" from scratching or causing indentations in other parts of a handbag that may be made of softer materials such as leather or other animal skin, fabric, patent leather, vinyl or other synthetic materials. Such loose pieces of felt or other fabric, which can also be inserted to separate certain soft components from other soft components, can be awkward, and are easily lost or separated from the handbag they were intended to be used with. As a further example of the prior art, practitioners of the art have created so-called pillows to rest a handbag upon or to insert into the interior of a bag.

The prior methods of and devices for protection may suffer from one or more drawbacks, including, without limitation: lack of effectiveness, lack of efficiency, and inconvenience of use. In particular, the invention is quick and easy to use and offers expanded and carefully considered protective features as compared to the prior art.

DETAILED DESCRIPTION OF THE INVENTION

Figure 1:
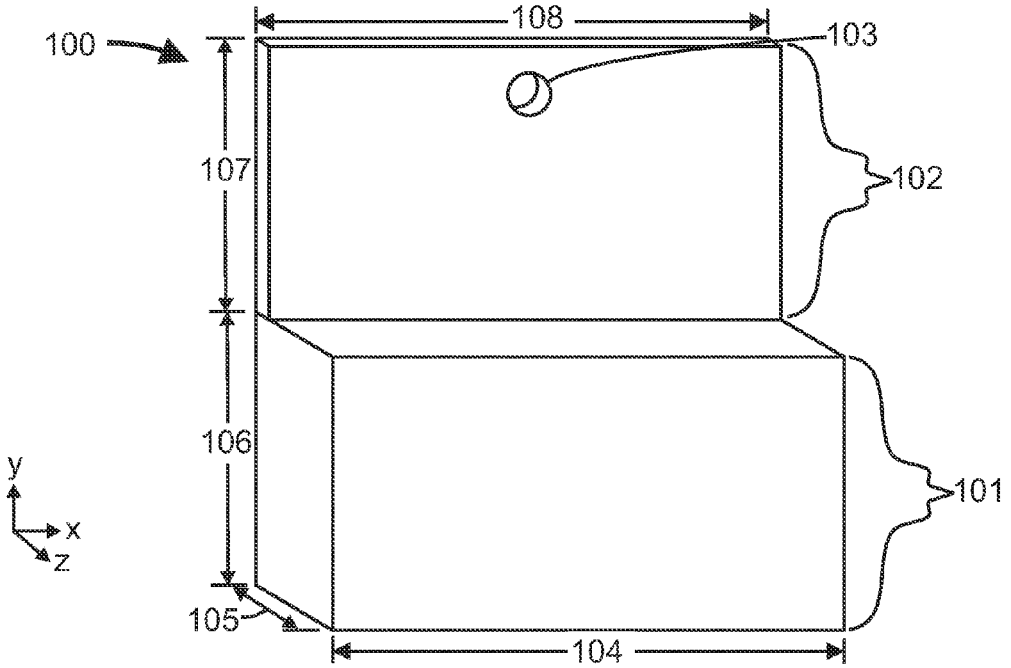
FIG. 1 is a perspective view of the front of one embodiment of a handbag protection device including a base region and a flap extension with an opening.

The features and other details of the invention will now be more particularly described. It will be understood that particular embodiments described herein are shown by way of illustration and not as limitations of the invention. The principal features of this invention can be employed in various embodiments without departing from the scope of the invention. All parts and percentages are by weight unless otherwise specified.

Accordingly, it is an object of one embodiment to provide an efficient, effective, aesthetically appealing and easy-to-use device to protect and preserve the condition of handbags during storage, transport and in other conditions that overcomes the drawbacks of the prior art.

It is an object of one embodiment to allow users to quickly deploy the device to protect certain components of a handbag that may be susceptible to wear, deterioration or damage from storage or transport. The prior art either protects less effectively, takes more time to use, or has other problems.

Embodiments of the device can be made in various sizes, appropriate for different manufactures and models of handbags, with such additional regions or enclosures to protect any components of a handbag that may need protecting.

Definitions

"Handbag" is defined herein as a transportation container with such container comprising at least one compartment or cavity and with such handbag operatively configured for transportation by an individual Examples of handbags include, without limitation, purses, pocketbooks, attaché cases, briefcases, and other carrying bags or luggage.

Handbag Protection Device

In one embodiment, a handbag protection device comprises a base region and at least one flap extension. In another embodiment, a handbag protection device comprises a base region and at least one support extension. In a further embodiment, a handbag protection device comprises a base region, at least one flap extension, and at least one support extension.

In accordance with one embodiment, a base region of the device is intended to be placed within the primary carrying compartment of a handbag to fill or expand the carrying compartment in a way that is intended generally to maintain or to help to maintain the shape of the handbag, without either expanding the dimensions of the handbag beyond their desired size or permitting the handbag to collapse to a size that is smaller than the desired size. The manufacturer or a user of the device may configure the device to provide the desired effect for such shape maintenance in accordance with the dimensions and other attributes of the handbag.

In accordance with another embodiment, a flap extension extends from the base region of the device and extends out of the primary carrying compartment of a handbag to lay between the main body of the handbag, in which the primary carrying compartment of the handbag is located, and any cover or flap of the handbag used to enclose or protect or cover a portion of the body (or to protect, cover or enclose a carrying compartment) of the handbag or any other component of the handbag that may touch the flap of the handbag during transportation or storage of the handbag. In one embodiment the flap extension is thinner than the base region. In one embodiment, an operatively detachable flap extension is affixed to the base region. In a further embodiment, the flap extension is integrated with the base region.

In accordance with a further embodiment, the device comprises one or more detached or attached support extensions that enclose or protect or cover a region of one or more chains, straps, handles, or components of the handbag that can be used for carrying, hanging, or other transporting, storing, or functional use of the handbag or to enclose or protect or cover a region of one or more components used for decoration of the handbag.

Base Region

In accordance with one embodiment, a base region of the device is intended to be placed within an inner or primary carrying compartment of a handbag to fill or occupy the carrying compartment in a way that maintains or helps to maintain handbag shape, without either expanding the dimensions of the handbag beyond their desired size or permitting the handbag to collapse to a size that is smaller than the desired size. In another embodiment, the base region is a volume of material with sufficient resilience, rigidity, thickness, and shape to support or extend the walls or other boundary or boundaries of an inner or primary carrying compartment of the handbag to a desired shape. In another embodiment, additional fill inserts, detached or attached, may be used to support or extend one or more carrying compartments other than the inner or primary carrying compartment of the handbag or one or more other compartments of the handbag.

Base Region Shape and Size

In one embodiment, the base region of the device can be formed into different shapes to conform with or complement an inner carrying or storage cavity or compartment of the handbag depending on shape of the handbag or the carrying or storage cavity or compartment. In one embodiment, a base region is a shape with a rectangular cross-section, a shape with a trapezoidal cross-section, a shape with a triangular cross section, a shape with a polyhedral cross section, a shape with a cross-section comprising rounded corners, a shape with an oval or circular cross-section, or any shape that would at least partially fill or occupy a carrying or storage compartment, inner cavity, or other space in the interior of the handbag. In another embodiment, the handbag protection device comprises a base region and one or more extensions extending from the base region. In one embodiment, the base region has a length, width, and depth where the depth direction intersects the opening to the cavity or inner or primary carrying or storage compartment of the handbag in which it is to be inserted and is substantially the direction through which items to be carried or stored components are added to or removed from the primary carrying or storage compartment of the handbag. In one embodiment, the ratio of the length to the width of the base region is one or more selected from the group: 1, greater than 1, greater than 2, greater than 3, greater than 4, greater than 5, less than 10, and less than 5. In another embodiment, the length is greater than 1 inch and the width is greater than 0.25 inches. In one embodiment the depth is greater than 1 inch. In a further embodiment, the length is greater than 3 inches, the width is greater than 0.5 inches and less than 3 inches, and the depth is greater than 2 inches. In another embodiment, the length is greater than 3 inches, the width is less than 0.5 inches, and the depth is greater than 2 inches.

In one embodiment, the base region has a width that varies in the depth direction. For example without limitation, the cross section of the base region in a plane parallel to the depth direction has the shape of a trapezoid with the width of a first volume region defined in the portion of the base region distal from the flap extension that is larger than a second volume region defined in the portion of the base region that is closer to a flap extension.

In one embodiment, the base region includes a pouch or cavity. The pouch or cavity may be formed within a single material or within a layer of two or more similar or dissimilar materials. For example, in one embodiment, a handbag protection device includes a base region including a foam material wherein the support cavity is defined by a cavity in the foam material. In another embodiment, a handbag protection device includes a base region including two layers of different or similar materials sewn together to form a support pouch wherein a chain, or other extension from a handbag may be placed.

Adjustable Base Shape

In one embodiment, the base region is adjustable in shape or firmness. In another embodiment, the base region comprises a gathering of a first material operatively configured to enclose a volume of a second material. In one embodiment the first material is the same as the second material. In another embodiment, the second material is different than the first material. For example, in one embodiment, the base region comprises a sewn arrangement of a fabric material with an opening through which a fill material may be added into such that the base region forms a sustaining shape. In this embodiment, a user of the device or the manufacturer of the device may add one or more fill materials to provide a predetermined level of rigidity, firmness, fill shape, or other benefit (such as a preference to use a particular fill material). For example, the user or manufacturer may add blocks or shapes of foam or other material with particular shapes to expand out or fill the handbag to a particular level or match the shape of the handbag. The opening may be closed by positioning a flap or other shape on the opening or it may be closed by bringing and holding one or more wall regions of the gathering of material and affixing or fastening them together using a fastening mechanism, such as, for example without limitation, a hook and loop fastener or a zipper fastener. In another embodiment, the manufacturer may seal the opening by sewing it shut.

Pre-Determined Fill Volume Shapes or Sleeves that can be Filled

In another embodiment, the gathering of material is a stretchable material such as a nylon material or other material that can be stretched. In one embodiment, the base region comprises a gathering of material and a cavity in which are positioned one or more shapes of material, such as foam, preconfigured or user customized to provide a specific firmness or shape that can support the handbag, the handbag's shape or any component(s) of the handbag. In one embodiment, the shapes of fill materials are polyhedrons, cubes, cylinders, spheres, oblong spheres, elongated prisms, or other shapes or any combination of shapes that can fill or build a collection of shapes that conform to the interior volume of the primary compartment of a handbag. In one embodiment, the base region comprises a gathering of material and a cavity in which are positioned one or more support structures preconfigured or user customized to provide a specific firmness or shape that may support the handbag in a specific shape or level of firmness. In one embodiment, the support structures comprise an elastically deformable material. For example, in one embodiment, the gathering of material is a stretchable weave of cotton and nylon and the support structures comprise u-shaped plastic or aluminum frame(s) with cardboard flaps covered in a soft cotton material. In this example, the plastic or aluminum frame(s) can be adjusted and the resulting shape of the support structure can be positioned within the cavity of the gathering of material to form the precise shape and rigidity desired for the device to support the handbag. In another embodiment, the gathering of material comprises a plurality of cavities or sleeves into which one or more shapes or support structures may be inserted.

Flap Extension

In one embodiment, a flap extension is employed to protect one or more flaps or closures of a handbag. In another embodiment, the flap extension is longer in a first direction, or wider, with extensions or wings, so that it can separate an inner flap or cover of the handbag from the body of the handbag and extend beyond such inner flap or cover. In this embodiment, the excess portion extending beyond the inner flap or cover can be extended to separate the inner flap or cover from an outer flap, a cover, a second flap, or a second cover of the handbag that is more distant from the body of the handbag.

Shape of the Flap Extension

The flap extension may be shorter, the same length as or longer than the flap or closure of the handbag that is separated from the body of the handbag by the flap extension. The flap extension need not be of uniform thickness or composition. The flap extension may be made of the same or a different material(s) as the base region of the device and may be made of one or more materials. In one embodiment, the flap extension is substantially in the shape of a rectangle, square, oval, polyhedron, semicircle, triangle, or other shape or combination of shapes that can cover one or more potential regions of contact between the flap of the handbag and a second surface of the handbag. In one embodiment, the shape of a flap extension may include extensions or wings that may be the same or a different shape from a main portion of such flap extension In one embodiment, the flap extension is operatively configured to separate multiple flaps or covers of a handbag if they are present. In one embodiment a device comprising a base region and a flap extension comprised of a main portion of such flap extension and at least one additional flap, cover, wing, or other extension to the flap extension integrated into or operatively attached to the flap extension, and one or more closures, fasteners, or attachment mechanisms are attached to the flap extension to fasten one portion of the flap extension to another portion of the flap extension or the base region.

Thickness of the Flap Extension

In one embodiment, the average thickness of the flap extension is one or more selected from the group: less than 20% of the average width of the base region, less than 10% of the average width of the base region, less than 5% of the average width of the base region, less than 10 mm, less than 7 mm, less than 5 mm, less than 3 mm, and less than 2 mm. In another embodiment the average thickness of the flap extension is the same as the average width of the base region. In another embodiment, the average thickness of the flap extension is less than the average width of the base region.

Depth of the Flap Extension

In one embodiment, the average depth of the flap extension is one or more selected from the group: the same as the average depth of the base region, greater than the average depth of the base region, less than the average depth of the base region, greater than 1.5 times the average depth of the base region, greater than 2 times the average depth of the base region, greater than 3 times the average depth of the base region, and greater than 4 times the average depth of the base region. In one embodiment, the average depth of the flap extension is one or more selected from the group: greater than the width of the base region, the same as the width of the base region, less than the width of the base region, greater than 0.5 inches, greater than 1 inch, greater than 2 inches, greater than 3 inches, greater than 5 inches, and greater than 10 inches.

In one embodiment, the flap extension depth is greater than the depth of the base region such that it can extend around and protect the region of the handbag or flap where the handbag flap would touch the body of the handbag. In a further embodiment, the depth of the flap extension is sufficiently long to wrap around the bottom, back, top and front of the handbag, thus protecting a significant portion or a majority of the outer surface area of the handbag.

Length of Flap Extension

In one embodiment, the average length of the flap extension is one or more selected from the group: the same as the average length of the base region, greater than the average length of the base region, less than the average length of the base region, greater than 1.5 times the average length of the base region, greater than 2 times the average length of the base region, and greater than 3 times the average length of the base region. In one embodiment, the flap extension length is greater than the length of the base region such that it can extend around and protect the one or more sides, underside, or top of the handbag. In a further embodiment, the length of the flap extension is sufficiently long to wrap around the bottom, the back, the top, and the flap or front of the handbag, thus protecting a significant area of the outer surface area of the handbag. In another embodiment, the length of the flap extension is sufficiently long and shaped appropriately to wrap around the bottom, the back, the first side, the second side, the top, and the flap or front of the handbag, while also separating the flap of the handbag from the body of the handbag, thus protecting a significant area of the outer surface area or substantially the entire outer surface area of the handbag and the flap of the handbag.

Flap Extension Hole, Opening, Slit or Notch

The flap extension may have one or more holes or perforations to accommodate the passage or fastening of hardware, such as, without limitation, a snap-closed clasp, a twist-closed clasp, a hooked clasp, magnetic clasp or other closure for the handbag or decorative or ornamental components of the handbag. In one embodiment, the area of the flap extension opening is greater than one selected from the group: 0.5 $cm^2$, 1 $cm^2$, 1.5 $cm^2$, 2 $cm^2$, 4 $cm^2$, 6 $cm^2$, 8 $cm^2$, and 10 $cm^2$. In another embodiment, the opening is a notch in the flap extension material that extends to an edge of the flap extension. In one embodiment, the opening in the flap extension is substantially in the shape of a rectangle, square, oval, polyhedron, semicircle, triangle, notch, slit or other shape or combination of shapes that provides for the absence of the flap extension material in the region between the fastening components of the handbag flap and the handbag. In one embodiment, the device comprises one or more flap or support extensions and one or more flap or support extensions comprise an opening, hole, slit or notch.

Attachment Location of Flap Extension

In one embodiment, the flap extension is operatively attached or extended from the base region. In another embodiment, the flap extension is operatively attached or extended from the base region along a length edge. In another embodiment, the flap extension is operatively configured to be removable and re-attachable to the base region.

Number of Flap Extensions

In one embodiment, a handbag protection device comprises a base region and at least two flap extensions extending from or operatively attached the base region. In one embodiment, two flap extensions may be used to protect a double-flap type handbag. In one embodiment, two flap extensions may also be used to protect a single-flap type handbag.

Flap Extension Comprising Strengthening Material

In one embodiment, one or more flap extensions comprises a strengthening material positioned in one or more regions of one or more flap extensions operatively coupled to a fastening mechanism. By using a strengthening material, the durability of the flap extension when fastened and unfastened many times will be improved relative to a flap extension without a strengthening material. For example, in one embodiment, a handbag protection device comprises long flap extension wherein when the device is placed within the primary compartment of the handbag, the flap extension extends and wraps around the perimeter of the handbag and fastens by a hook and loop fastener onto itself. In this example, the flap extension comprises a felt material with a broadcloth material sewn onto the felt material to increase the strength of the flap extension such that the flap extension does not tear or fray after the fastener is opened and closed many times. In another embodiment, a coating may be applied to a flap comprising a fabric material on at least one side of such fabric material to strengthen the material.

Detachable/Re-Attachable Flap Extension

In one embodiment, the device comprises one or more removable and re-attachable flap extensions. The attaching and removing mechanism could be a fastener such as, without limitation, a hook and loop fastener, a magnetic based fastener, a zipper, a button, or other fasteners known to be used with fabrics, clothing, or similar flexible materials.

In another embodiment, one or more flap extensions may be affixed to the base region depending on the desired area of protection or coverage. For example, in the user or manufacturer may wish to configure the device by attaching a short flap extension to the base region to protect the one side of the handbag with a handbag flap fastener or the user or manufacturer may choose to attach a flap extension that is very long to extend it around the perimeter of the handbag.

Support Extension

In one embodiment, the device comprises a base region and at least one support extension for protecting one or more straps, chains, handles, or other carrying components or extensions of the handbag that can be used for carrying, hanging, or supporting the handbag or a component of the handbag. In another embodiment the support extension may be for protecting decorative components of the handbag. The support extension may comprise one or more materials found within the base region or flap extension or one or more other materials and can wrap, cover, separate, enclose or partially enclose regions of one or more chains, straps, handles, or other carrying component or extension of the handbag that can be used for carrying, hanging, or supporting the handbag or a component of the handbag, or wrap, cover, separate, enclose or partially enclose regions of one or more decorative components. The mechanism for wrapping around, covering, separating, enclosing or partially enclosing may be through a fastener or an affixing means, such as hook and loop fasteners, magnets, reusable tape or other reusable affixing means, or it may be by the creation of a tube or other shape of enclosure with an inner cavity.

Shape of the Support Extension

In one embodiment, the support extension is a rectangular extension operatively coupled to the base region such that it can wrap around, cover, separate, enclose or partially enclose, or otherwise offer a barrier or protection layer for a strap, chain, handle, or other carrying component or extension of the handbag that can be used for carrying, hanging, or supporting the handbag or for another component of the handbag. The shape of the support extension does not need to be uniform in thickness or composition. The support extension may be made of the same or a different material(s) as the base region or flap extension (if included) of the device and may be made of one or more materials. In one embodiment, the support extension is substantially in the shape of a rectangle, square, oval, polyhedron, semicircle, triangle, or other shape or combination of shapes that can cover, wrap around, separate, enclose or partially enclose a strap, chain, handle, or other carrying component or extension of the handbag that can be used for carrying, hanging, or supporting the handbag or another component of the handbag. In one embodiment, the support extension is a flap extending from a width edge of the base region. In one embodiment, the support extension includes a pouch wherein a chain, strap, handle or other carrying component or extension of the handbag may be fully or partially disposed therein. For example, in one embodiment, a handbag protection device includes a first layer of material longer than a second layer of material wherein the second layer of material is operatively coupled in a first end region of the first layer of material to form a support pouch. In this embodiment, for example, hook and loop fasteners (or other fasteners) may be positioned on the first layer of material and second layer of material in the region defining the support pouch such that the support pouch may be closed (such as when a portion of a handbag chain is deposited within the support pouch). Furthermore, in this embodiment, the first layer of material can include a hook material and loop material (or other fastener) on opposite sides of the first layer in a flap extension region defined as the region of the first material past the support pouch region. In this embodiment, the flap extension can pass between the handbag flap and the body of the handbag and completely around the handbag such that the hook material and loop material on the flap extension fasten together and protect the outer surface of the handbag. In one embodiment, the support extension comprises one or more closures, fasteners, or attachment mechanisms to fasten one portion of the support extension to another portion of the support extension, a flap extension, or the base region.

Cavity within the Support Extension

In another embodiment, the support extension comprises an inner cavity that can enclose or partially enclose a region of a strap, chain, handle, or other carrying component or extension of the handbag that can be used for carrying, hanging, or supporting the handbag or a component of the handbag. The cavity within the support extension may be closed at one or both ends and may be attached to or detached from the base region or a flap extension or another support extension. The support extension may have an opening to the cavity at one or more locations selected from the group: at one end, at both ends, at the end opposite the edge attached to the base region, at an edge adjacent the base region, at the end opposite the edge attached to the flap extension or other support extension, at an edge adjacent the flap extension or other support extension, in the middle of the support extension, and along one or more locations along the length of the support extension between the ends.

In another embodiment, the support extension is in the shape or form of a pocket positioned on the "inside" or the "outside" of the base region or flap extension. In another embodiment, the support extension is detachable from the device such that the strap, chain, handle, or other carrying component or extension of the handbag that can be used for carrying, hanging, or supporting the handbag or another component of the handbag, including without limitation a decorative component, is enclosed or partially enclosed separately from the base region. In one embodiment, the flap extension comprises a support extension in the form of a pocket on a surface such that when the flap extension wraps around one or more sides or the perimeter of the handbag, the strap, chain, handle, or other carrying component or extension of the handbag that can be used for carrying, hanging, or supporting the handbag or a component of the handbag can be inserted inside the support extension.

Detachable/Re-Attachable Support Extension

In one embodiment, the device comprises one or more removable and re-attachable support extensions. The attaching and removing mechanism for the support extension could be a fastener such as, without limitation, a hook and loop fastener, a magnetic based fastener, a zipper, a button, or other fasteners known to be used with fabrics, clothing, or similar flexible materials.

In another embodiment, one or more support extensions may be affixed to the base region or flap extension (if included) depending on the desired area or component protection or coverage. For example, the user or manufacturer may wish to configure the device by attaching a rectangular shaped support extension to the length edge of the base region to wrap around the pulled-through chain of the handbag or the user or manufacturer may wish to configure the device by attaching a long rectangular support extension with a cavity to the width side of the base region in order to insert the chain of the handbag inside the cavity of the support extension.

Closure of the Support Extension

In one embodiment, the support extension is detachably or non-detachably affixed to the base region and the support extension further comprises an attachment or affixing mechanism to enable it to stay wrapped around, enclosed, or partially enclosed around or to cover or separate the component it is protecting. In this embodiment, the complementary component of the attachment mechanism may be positioned on the base region, a different region of the support extension, the inner surface of a flap extension, the outer surface of a flap extension or another region of a flap extension. For example, in one embodiment, the support extension is a flap extending from the base region comprising the loop component of a hook and loop fastener and the hooks are disposed on the outer surface of the front of the base region such that the support extension can be wrapped around the chain of the handbag and the loops in the support extension can be affixed to the hooks on the base region. In another embodiment, the affixing mechanism is chosen such that a separate complementary attachment component is not needed. For example, the support extension could comprise the hook portions of a hook and loop fastener and the outer surface material of the base region could be chosen to accept and hold the hooks on the material. In another embodiment, the support extension does not comprise an attachment mechanism. For example, the support extension in the form of a flap attached to the base region configured to wrap around a chain may not comprise an attachment mechanism if the support extension is long and can wrap around the chain of the handbag more than once or several times. As a further example of one embodiment, the support extension may be a tube of material into which the chain of the handbag or another component of the handbag may be inserted through an opening in the support extension.

Attachment Location of Support Extension

In one embodiment, the support extension is operatively attached or extended from the base region. In another embodiment, the support extension is operatively attached or extended from the base region along a width edge, length edge, or depth edge of the base region. In another embodiment, the flap extension is operatively configured to be removable and re-attachable to the base region. In another embodiment, the support extension is operatively attached to the base region adjacent the flap region. In a further embodiment, the support extension is a separate component that may or may not be detached from the base region that provides protection to a strap, chain, handle, or other carrying or decorative component or extension of the handbag that can be used for carrying, hanging, or supporting or ornamenting the handbag or a component of the handbag without being operatively coupled to the base region. In another different embodiment, the support extension may be operatively attached to a flap extension or another support extension.

Thickness of the Support Extension

In one embodiment, the average thickness of the support extension is one or more selected from the group: less than 20% of the average width of the base region, less than 10% of the average width of the base region, less than 5% of the average width of the base region, less than 10 mm, less than 7 mm, less than 5 mm, less than 3 mm, and less than 2 mm. In another embodiment, the average thickness of the support extension is the same as the average width of the base region. In another embodiment, the average thickness of the support extension is less than the average width of the base region.

Length of the Support Extension

In one embodiment, the average length of the support extension is one or more selected from the group: the same as the average length of the base region, greater than the average length of the base region, less than the average length of the base region, greater than 1.5 times the average length of the base region, greater than 2 times the average length of the base region, greater than 3 times the average length of the base region, greater than 4 times the average length of the base region, greater than 5 cm, greater than 10 cm, greater than 15 cm, greater than 20 cm, greater than 25 cm, greater than 30 cm, greater than 35 cm, greater than 40 cm, greater than 45 cm, and greater than 50 cm. In one embodiment the average length of the support extension is one or more selected from the group: greater than the width of the base region, the same as the width of the base region, and less than the width of the base region.

In one embodiment, the ratio of the support extension in the length direction to the support extension in the width or depth direction is greater than one selected from the group: 1, 2, 3, 4, 5, 6, 7, 8, 9, and 10. In another embodiment, the ratio of the support extension in the width or depth direction to the support extension in the length direction is greater than 1, 2, 3, 4, 5, 6, 7, 8, 9, and 10.

In one embodiment, the support extension is greater in the length direction than the width direction and the length of the support extension is such that a significant portion of a chain or strap from the handbag may fit into a cavity within the support extension.

Depth or Width of the Support Extension

In one embodiment, the average depth or width of the support extension is one or more selected from the group: the same as the average depth of the base region, greater than the average depth of the base region, less than the average depth of the base region, greater than 1.5 times the average depth of the base region, greater than 2 times the average depth of the base region, greater than 3 times the average depth of the base region, and greater than 4 times the average depth of the base region. In one embodiment, the average depth or width of the support extension is one or more selected from the group: greater than the average width of the base region, the same as the width of the base region, less than the average width of the base region, greater than 0.5 inches, greater than 1 inch, greater than 2 inches, greater than 3 inches, greater than 5 inches and greater than 10 inches.

Number of Support Extensions

In one embodiment, a handbag protection device comprises a base region and at least two support extensions extending from or operatively attached the base region. In this embodiment, for example, two support extensions may be used to protect two regions of a handbag chain or one support extension may protect the lateral or side edges of the handbag chain from damaging the interior of the handbag and the other support extension may wrap around the handbag chain or the support extensions may overlap.

Handbag Extension Securing Fasteners

In one embodiment, the support extension comprises one or more handbag extension securing fasteners to secure to the support extension one or more handbag extensions, such as straps, a chain (or region of a chain such as the external chain links or internal chain links), a handle, or other carrying or decorative component or extension of the handbag that can be used for carrying, hanging, or supporting or ornamenting the handbag or a component of the handbag. The handbag extension securing fastener may be one or more different types of fasteners, attachment mechanisms, or affixing mechanisms. One or more of the fasteners, attachment mechanisms, or affixing mechanisms may be operatively coupled to the support extension or attached to the support extension by sewing, gluing or adhesive, clamping, or using a different or similar fastener, attachment mechanism, or affixing mechanism. In one embodiment, the handbag extension securing fasteners wrap around or operatively secure one or more segments, lengths, or loops of a handbag extension, such as a chain, strap, a chain and strap combination, or a handle. For example, in one embodiment, a handbag extension securing fastener may wrap around one or more chain links, a bundle of chain links, or segments of rows of chain links. In one embodiment, one or more handbag extension securing fasteners are positioned at the lateral edge of the support extension. In one embodiment, one or more handbag extension securing fasteners are positioned on the same inside of the support extension when the support extension is closed. In another embodiment, one or more handbag extension securing fasteners are positioned on the outside of the support extension when the support extension is closed. In another embodiment, one or more handbag extension securing fasteners are positioned on one or more sides of the support extension. In another embodiment the support extension does not close. In one embodiment, one or more handbag extension securing fasteners comprises a tube or channel of material through which the handbag extension, or a portion thereof, may be fed.

In one embodiment, the lateral edges of the support extension are the edges of the support extension that are bent or folded to close or fasten the support extension. In one embodiment, the support extension comprises 1, 2, 3, 4, 5, or more than 5 handbag extension securing fasteners. In another embodiment, one or more handbag extension securing fasteners are positioned at a handbag extension securing fastener distance, D, from the lateral edge of the support extension. In one embodiment, D is greater than one selected from the group: 1 millimeter, 5 millimeters, 10 millimeters, 15 millimeters, 20 millimeters, 25 millimeters, 30 millimeters, 1% of the transverse width of the support extension, 2% of the transverse width of the support extension, 4% of the transverse width of the support extension, and 10% of the transverse width of the support extension where the transverse width of the support extension is the width of the support extension transverse to the lateral edge of the support extension and transverse to the thickness direction of the support extension material (such as a sheet of cloth or material, for example). For example, in one embodiment, a support extension comprises a section of material with a hook and loop support extension fastener to close around external chain links of a handbag, wherein the support extension further includes a plurality of handbag extension securing fasteners (in this embodiment chain securing fasteners) positioned on one side of the support extension and positioned to wrap around chain links or portions of chain links external to a handbag to maintain the position of the chain links and/or the chain relative to the support extension at the location of the chain securing fasteners. In this embodiment, the chain securing fasteners can prevent the chain links wrapped within the support extension from sliding or moving out of the support extension where they could scratch, abrade, indent or otherwise damage or harm a surface of the handbag.

Pockets

In one embodiment, the base region, one or more flap extensions, or one or more support extensions comprises one or more pockets. The pocket may be used, for example, to hold an authenticity card, identification card, information card, receipt desiccant packet, accessory or other item, including without limitation a detachable component of the handbag. In another embodiment, the pocket is sufficiently large to hold one or more flap extensions, or support extensions.

Component Material(s) of the Handbag Protection Device

In one embodiment, the base region, flap extension(s), support extension(s), or any component(s) thereof comprises one or more materials, such as without limitation, felt, broadcloth, other fabric, other textiles, or woven, padded or quilted materials, plastic, vinyl, patent leather, coated canvas, paper, cardboard, leather or other animal skin, or any other material used in packaging, handbag manufacture, clothing manufacture or for artistic expression. These materials can be used with one or more of the various embodiments and examples disclosed herein. For example, in some embodiments where felt is disclosed, one may use other fabric, other textiles or other woven, padded or quilted material instead of the felt material. In one embodiment, the device, or a component thereof comprises a primary material and a secondary material. In one embodiment the primary material provides a soft, protective, non-scratching surface. In another embodiment, the secondary material provides increased strength or support. Another or the same material may be used for fill. For example, in one embodiment the primary material of the flap extension comprises a felt fabric and the secondary material of the flap extension comprises a broadcloth fabric sewn on one side of the felt fabric that strengthens the region adjacent or proximate the hook region or loop region on the flap extension. In another example, the primary material of the flap extension comprises a felt fabric and the secondary material comprises reinforcing thread sewn into the felt fabric that strengthens the edges of the felt fabric and help prevent tears or fraying of the primary material when washing or when configuring or using the device. A primary material may be selected for its strength or durability, or a secondary material could be selected to add strength or durability.

Moisture Absorbing or Repelling Material

In another embodiment, the device or a component thereof comprises a desiccant material or microfiber material. A desiccant material is a hygroscopic material that can remove moisture from the ambient environment to prevent degradation of moisture sensitive materials. For example, a desiccant packet comprising silica gel may be incorporated into a handbag protection device or added to the device in a pocket. In one embodiment, the device comprises a microfiber material configured to wick away or repel moisture as in the case of "dry-wick" materials. Microfiber refers to synthetic fibers that measure less than one denier per filament. Denier is a measure of linear density and is commonly used to describe the size of a fiber or filament. Nine thousand meters of a 1-denier fiber weigh one gram. The most common types of microfibers are made from polyesters, polyamides (e.g., nylon, kevlar, nomex, trogamide), and or a conjugation of polyester and polyamide. Fibers are combined to create yarns. Microfibers are used to make non-woven, woven and knitted textiles. The shape, size and combinations of synthetic fibers are selected for specific characteristics, including: softness, durability, absorption, wicking abilities, water repellency, electrodynamics, and filtering capabilities. In one embodiment, the base region, the flap extension, the support extension, or a component thereof comprises a fibrous material comprising fibers with less than one or more selected from the group: 10, 5, 4, 3, 2, 1, 0.8, 0.6, 0.4, 0.2, and 0.1 denier per filament.

Base Region Materials

In one embodiment, one or more areas of the surface of the base region may be covered with one material, such as but not limited to felt, fabric, plastic, paper or cardboard and filled with the same or another material.

In another embodiment, the base region is filled up or comprises one or more materials selected from the group: foam, polyfill, polyester fiber, cotton fiber, sponge, bead fill, shredded materials, shredded plastic, shredded paper, feathers, animal hair, certain food products (for example, dried beans or rice) or other dried plant matter, leather, fabric, and other loose or solid fill. In one embodiment, the base region is a hollow or solid shape, for example made of plastic or wood. In another embodiment, the base region could be or be filled or occupied by a thin material stuffed into the space, such as, but not limited to, fabric, paper or plastic stuffed to fill or occupy a cavity or compartment within the handbag. The base region may comprise a cover or "skin" material that comprises a fill material within the interior of the base region.

In another embodiment, the device comprises a base region that may be filled by the user or the manufacturer to a level of firmness and support desired for the handbag.

In a further embodiment, the base region comprises one or more compartments, regions, pockets, or cavities on the outside or inside to hold one or more flap extensions or support extensions. For example, in one embodiment, a handbag protection device comprises a kit including a base region, one or more fill shapes or materials, and a plurality of attachable and detachable support extensions or flap extensions that can be operatively stored in one or more cavity regions upon or within the base region and attached, or detached within or upon the base region, a flap extension, a support extension or operatively coupled for use with the base region, a flap extension or a support extension.

Pigment or Dye Content

In one embodiment, the handbag protection device or a component thereof comprises a percentage of pigment or dye concentration by weight less than one selected from the group: 20%, 10%, 5%, 3%, 2%, 1% and 0.5%. In another embodiment, the device is substantially white or otherwise free or substantially free of pigments or dyes.

Pattern, Print, or Color of Primary or Secondary Component Material

In one embodiment, the device or component thereof comprises one or more regions with a fabric, pattern, coating or print of a different color than a neighboring region. For example, the flap extensions may be white with a small blue print pattern and the support extensions may be white with a small red pattern to distinguish the materials or functions. In another embodiment, the device or a component thereof comprises two or more colors identifying components or regions of components, such as for example the fastener region or the opening to the cavity region in a long support extension designed to hold a handbag chain. In one embodiment, white materials are employed to reassure to the user that color transfer would not occur from the device, or a component thereof, to the handbag. In another embodiment, a color, a matter, a coating or a print may be employed for decorative, aesthetic, information or other purposes. Such information may include, without limitation, instructions or diagrams to facilitate use of the device, or other writing, or other figures or diagrams, or other expression.

Handbag Kit

In one embodiment, a handbag kit or assembly includes a handbag and a handbag protection device. In one embodiment, the handbag is a single flap type, double flap type, single-chain type, double-chain type, fixed chain type, pull through chain type, handbag within a handbag type, or wallet type. Other handbags which may be used with embodiments include handbags known to those skilled in the art of handbag design or manufacture.

In one embodiment, a handbag kit includes a handbag, a handbag protection device and instructions for employing the handbag protection device. The instructions may be in the form of a separate component (such as paper, plastic, cloth) with instructions or they may be formed on or within the handbag or handbag protection device.

The following are more detailed descriptions of various embodiments illustrated in the Figures.

FIG. 1 is a perspective view of the front of one embodiment of a handbag protection device 100 comprising a base region 101 and a flap extension 102 comprising an opening 103. The base region 101 has a length 104 in the x direction, a width 105 in the z direction, and a depth 106 in the y-direction. The flap extension 102 has a length 108 in the x direction, a thickness in the z direction, and a depth 107 in the y-direction. When the handbag protection device 100 is placed within a handbag, the base region 101 fills out and protects the interior of the handbag and the flap extension 102 extends over the top of the base region and between the handbag flap and the body of the handbag when the flap is closed and affixed by a snap or other closing mechanism through the opening 103 in the flap extension 102.

Figure 2:
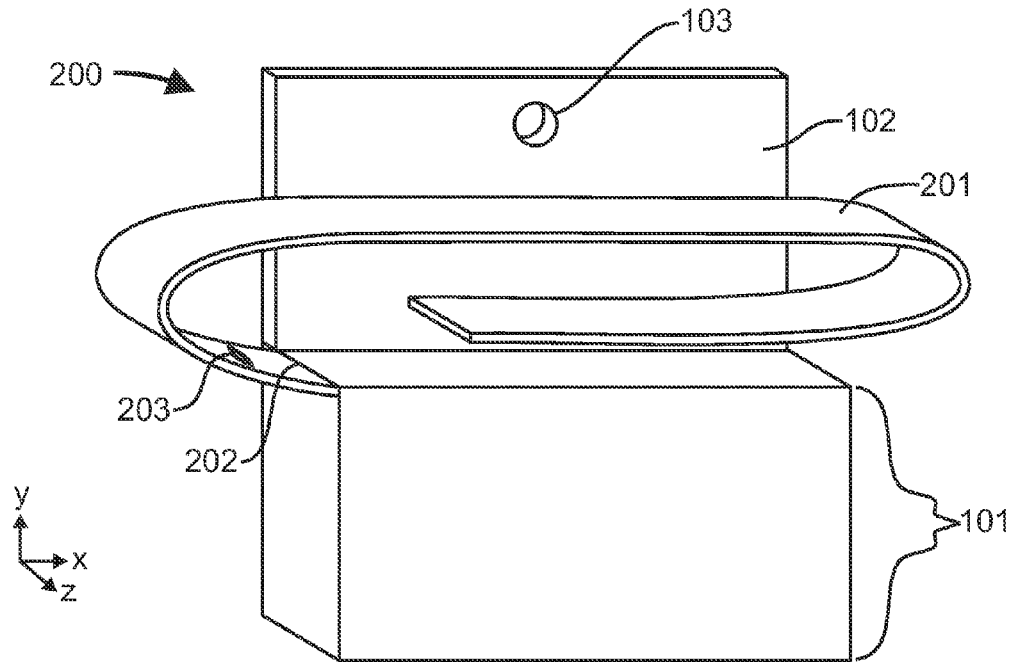
FIG. 2 is a perspective view of one embodiment of a handbag protection device including a tubular support extension.

FIG. 2 is a perspective view of one embodiment of a handbag protection device 200 comprising a base region 101, a flap extension 102 comprising an opening 103, and a tubular support extension 201 comprising a slit opening 203 attached to a width edge 202 of the base region 101. The support extension 201 has a longer length than width. When the handbag protection device 200 is placed within a handbag, the base region 101 fills out and protects the interior of the handbag. The handbag chain is pulled through the outer handbag flap, inserted through slit opening 203 so that a length of the handbag chain is enclosed by the tubular support extension 201. The support extension 201 enclosing a length of the handbag chain is laid between the inner handbag flap and the outer handbag flap when it is closed. The remainder of the tubular support extension 201 enclosing the remainder of a length of the handbag chain is wrapped around the end of the inner flap of the handbag opposite width edge 202 and positioned on the top of the base region 101. The flap extension 102 extends may be used so that it extends over the support extension 201 (or so that it does not extend over the support extension 201), and such flap extension 102 extends over the top of the base region 101, and between the handbag flap and the body of the handbag when the flap is closed and affixed by a snap or other closing mechanism through the opening 103 in the flap extension 102.

Figure 3:
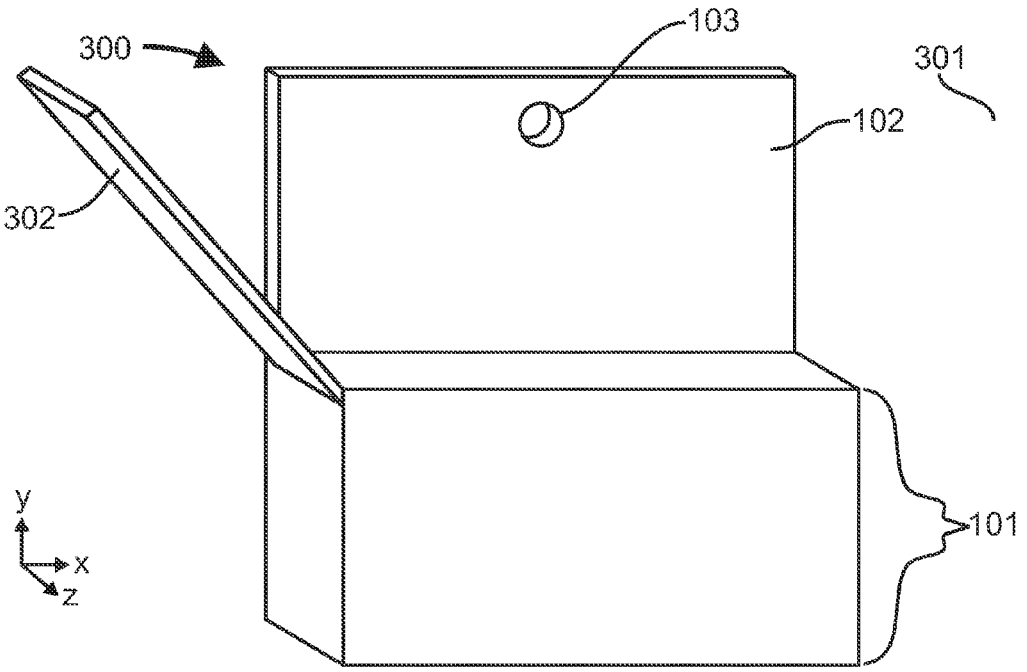
FIG. 3 is a perspective view of one embodiment of a handbag protection device including a first support extension and a second support extension.

FIG. 3 is a perspective view of one embodiment of a handbag protection device 300 comprising a base region 101, a flap extension 102 comprising an opening 103, a first support extension 301 and a second support extension 302. When the handbag protection device 300 is placed within a handbag, the base region 101 fills out and protects the interior of the handbag. The handbag chain is pulled through the outer handbag flap and positioned on the top of the base region 101. The first support extension 301 and the second support extension 302 are laid between the handbag chain and the handbag flap when it is closed. The flap extension 102 extends over the first support extension 301 and second support extension 302, over the top of the base region 101, and between the handbag flap and the body of the handbag when the flap is closed and affixed by a snap or other closing mechanism through the opening 103 in the flap extension 102.

Figure 4:
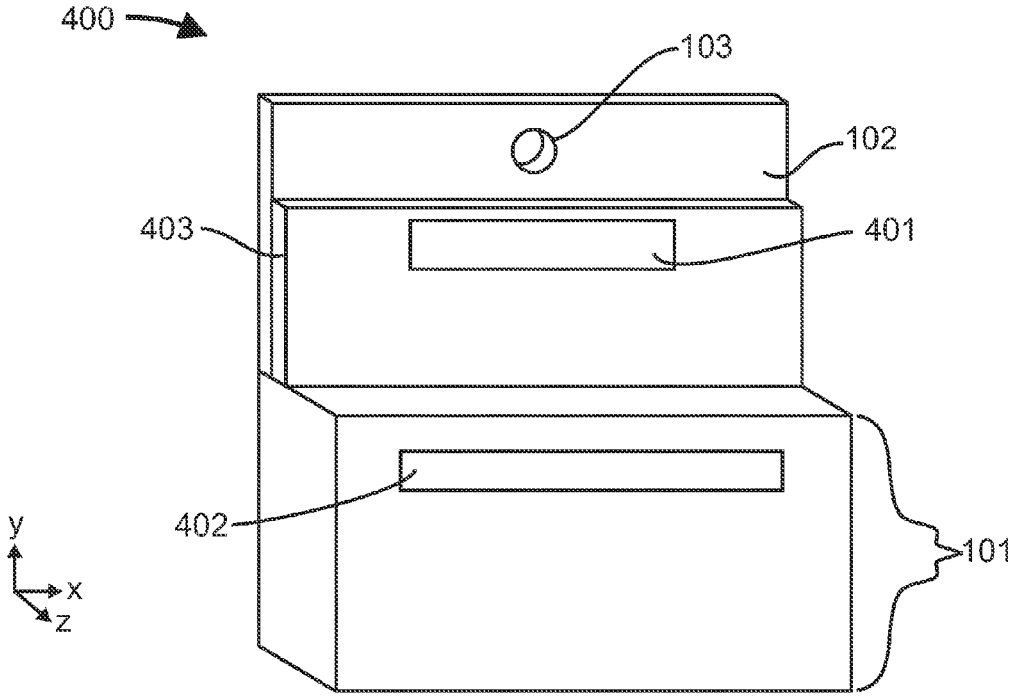
FIG. 4 is a perspective view of one embodiment of a handbag protection device including a base region, a flap extension with an opening, and a support extension.

FIG. 4 is a perspective view of one embodiment of a handbag protection device 400 comprising a base region 101, a flap extension 102 comprising an opening 103, and a support extension 403. When the handbag protection device 400 is placed within a handbag, the base region 101 fills out and protects the interior of the handbag. The handbag chain is pulled through the outer flap of the handbag and positioned on the top of the base region 101. The support extension 403 is extended over the handbag chain and is attached to the base region 101 by applying the loop material 401 on the inner surface of the support extension 403 to the hook material 402 on the base region 101 forming a hook and loop attachment mechanism to hold the support extension and confine the handbag chain in place and protect it from scratching or harming the inner surface of the inner handbag flap of the handbag or the inner lining of the handbag of the handbag when it is closed. The flap extension 102 extends over the support extension 403, over the top of the base region 101, and between the inner flap of the handbag and the body of the handbag when the inner flap of the handbag is closed and affixed by a snap or other closing mechanism through the opening 103 in the flap extension 102. As is the case with numerous other embodiments, this embodiment can be used to protect a handbag with more than one handbag flap (the preceding description in this paragraph contemplating use with a double flap handbag), or to protect a handbag with one flap (in which case the words "inner flap" and "outer flap" would be replaced by the word "flap" in the preceding description in this paragraph).

Figure 5:
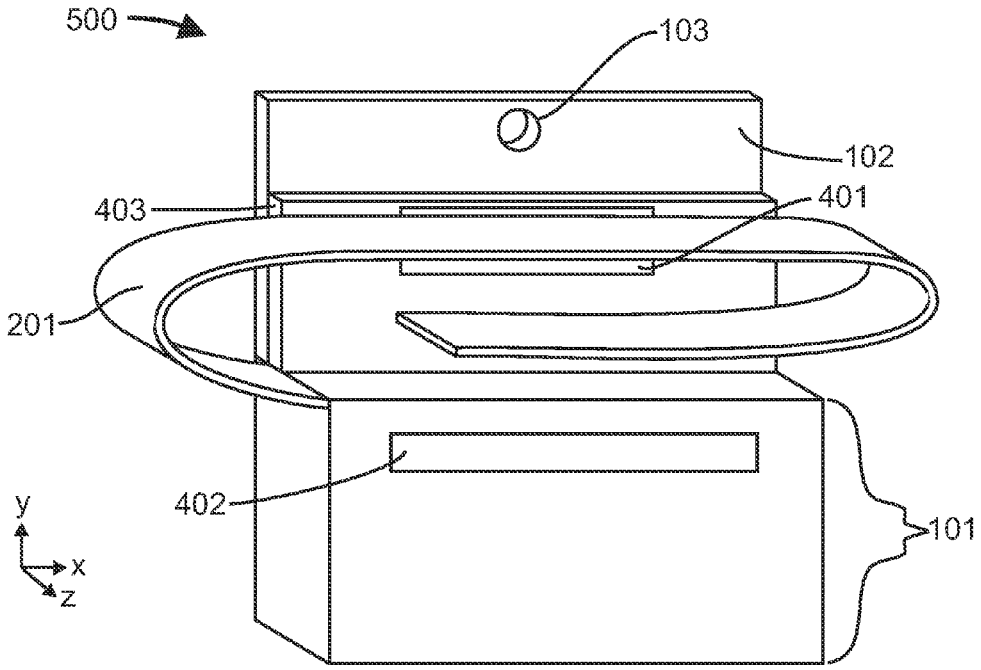
FIG. 5 is a perspective view of one embodiment of a handbag protection device including a base region, a flap extension with an opening, a first support extension and a second support extension.

FIG. 5 is a perspective view of one embodiment of a handbag protection device 500 comprising a base region 101, a flap extension 102 comprising an opening 103, a first support extension 403 and a second support extension 201. When the handbag protection device 500 is placed within a handbag, the base region 101 fills out and protects the interior of the handbag. The handbag chain is pulled through the outer handbag flap and around a side of the inner handbag flap and positioned on the top of the base region 101. The first support extension 403 attached to a width edge of the base region 101 is extended over the handbag chain. The first support extension 403 is extended over the top of the handbag chain, the top of the base region 101, and the second support extension 201 and is attached by applying the loop material 401 on the inner surface of the first support extension 403 to the hook material 402 on the base region 101 forming a hook and loop attachment mechanism to hold the handbag chain in place and protect it from scratching or harming the inner surface of the flap of the handbag or the inner lining of the handbag. The second support extension 201 is positioned between the handbag chain and the edge of the inner handbag flap that is closest to the handbag chain and the remainder of such second support extension 201 is placed between the outer flap of the handbag and the inner flap of the handbag to protect the inner flap of the handbag from indentation resulting from the portion of the handbag chain that would be positioned between the inner handbag flap and the outer handbag flap. The flap extension 102 extends over the first support extension 403, over the top of the base region 101, and between the handbag flap and the body of the handbag when the flap is closed and affixed by a snap or other closing mechanism through the opening 103 in the flap extension 102.

Figure 6:
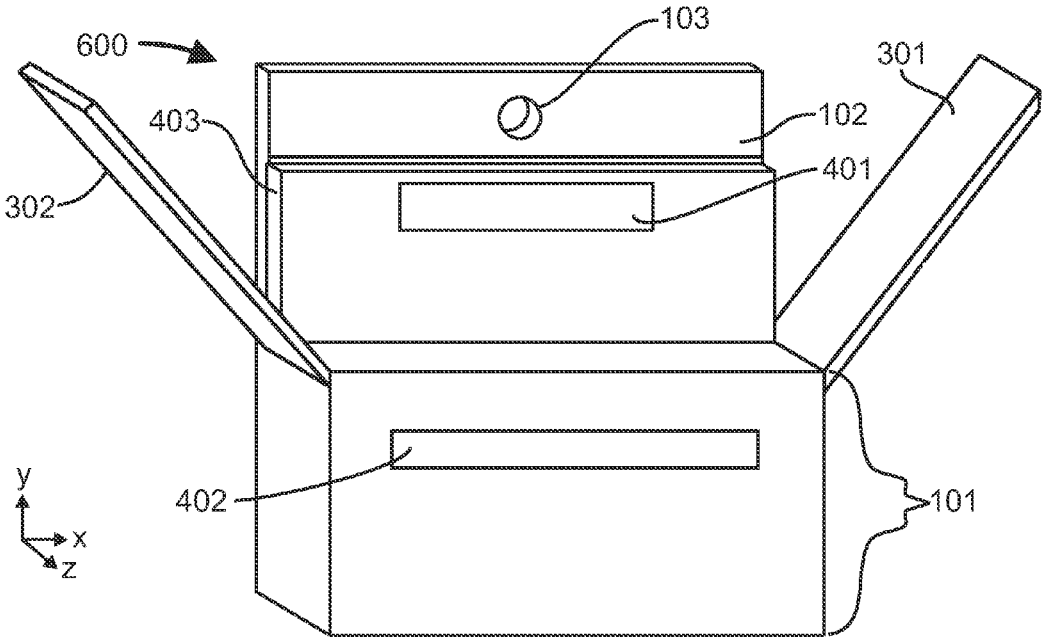
FIG. 6 is a perspective view of one embodiment of a handbag protection device including a first support extension, a second support extension, and a third support extension.

FIG. 6 is a perspective view of one embodiment of a handbag protection device 600 comprising a base region 101, a flap extension 102 comprising an opening 103, a first support extension 403, a second support extension 301, and a third support extension 302. When the handbag protection device 600 is placed within a handbag, the base region 101 fills out and protects the interior of the handbag. The handbag chain is pulled through the outer handbag flap and around a side of the inner handbag flap and positioned on the top of the base region 101. The first support extension 403 is extended over the handbag chain position on top of the base region 101 by applying the loop material 401 on the inner surface of the first support extension 403 to the hook material 402 on the base region 101 forming a hook and loop attachment mechanism to hold the handbag chain in place and protect it from scratching or harming the inner surface of the inner handbag flap or the inner lining of the handbag when it is closed. Each of the second support extension 301 and the third support extension 302 are extended around an outside edge of the inner flap of the handbag and positioned between the handbag chain and such edge of such inner flap and the remainder of such second support extension 301 and such third support extension 302 is positioned between the outer flap of the handbag and the inner flap of the handbag to protect the inner flap of the handbag from indentation resulting from the portion of the handbag chain that would be positioned between the inner handbag flap and the outer handbag flap.

The flap extension 102 extends over the first support extension 403, over the top of the base region 101, and between the handbag flap and the body of the handbag when the flap is closed and affixed by a snap or other closing mechanism through the opening 103 in the flap extension 102.

Figure 7:
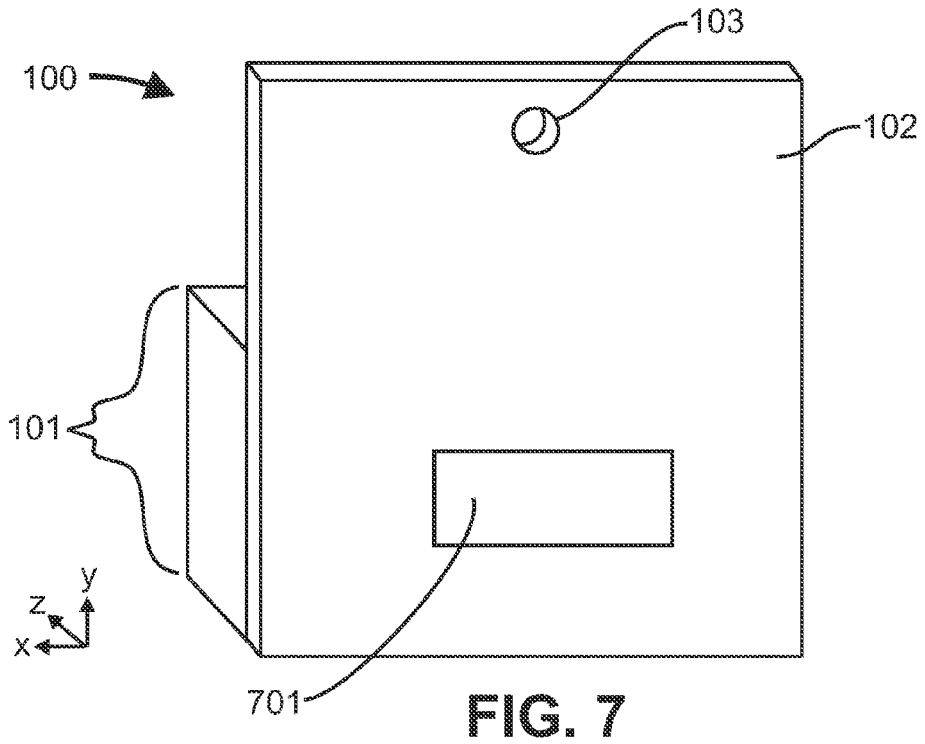
FIG. 7 is a perspective view of the rear of the handbag protection device of FIG. 1.

FIG. 7 is a perspective view of the rear of the handbag protection device 100 of FIG. 1 comprising a base region 101, a flap extension 102 comprising an opening 103, and a pocket 701 on the rear surface of the base region 101.

Figure 8:
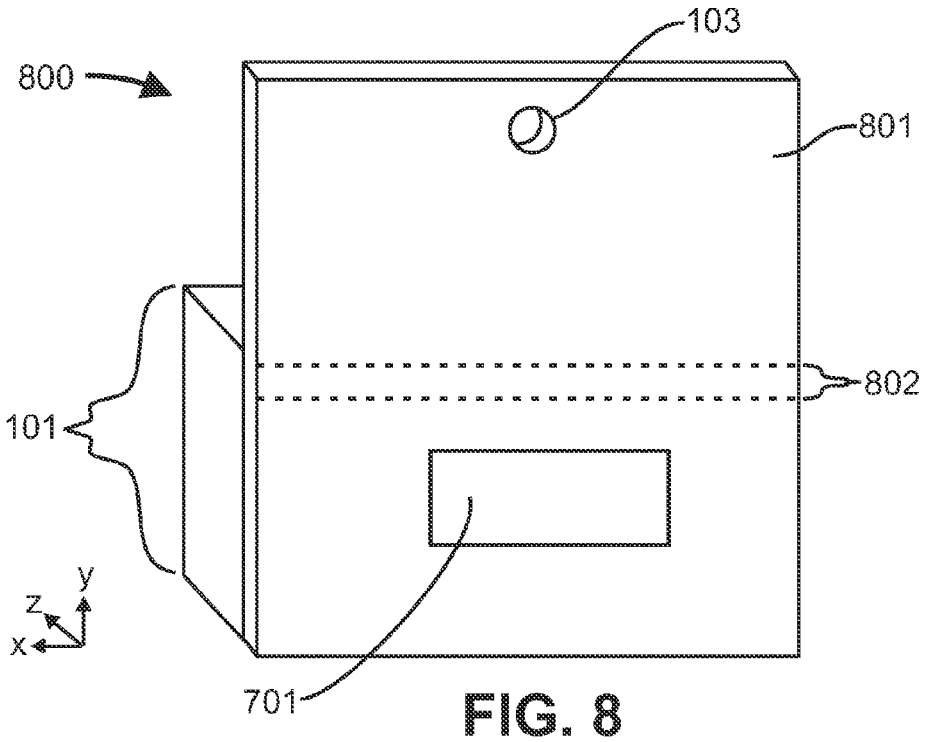
FIG. 8 is a perspective view of the rear of an embodiment of a handbag protection device including a base region and a detachable flap extension.

FIG. 8 is a perspective view of the rear of an embodiment of a handbag protection device 800 comprising a base region 101 and a detachable flap extension 801 comprising an opening 103 and a pocket 701 on the rear surface of the base region 101. The detachable flap extension 801 is detachable in the region 802 where the detachable flap extension 801 is connected to the base region 101. In this embodiment, the detachable flap extension 801 may be removed from the base region 101 and positioned between the handbag flap and the body of the handbag to protect the body and the flap when the flap is closed and attached by a snap or other closing mechanism through the opening 103.

Figure 9:
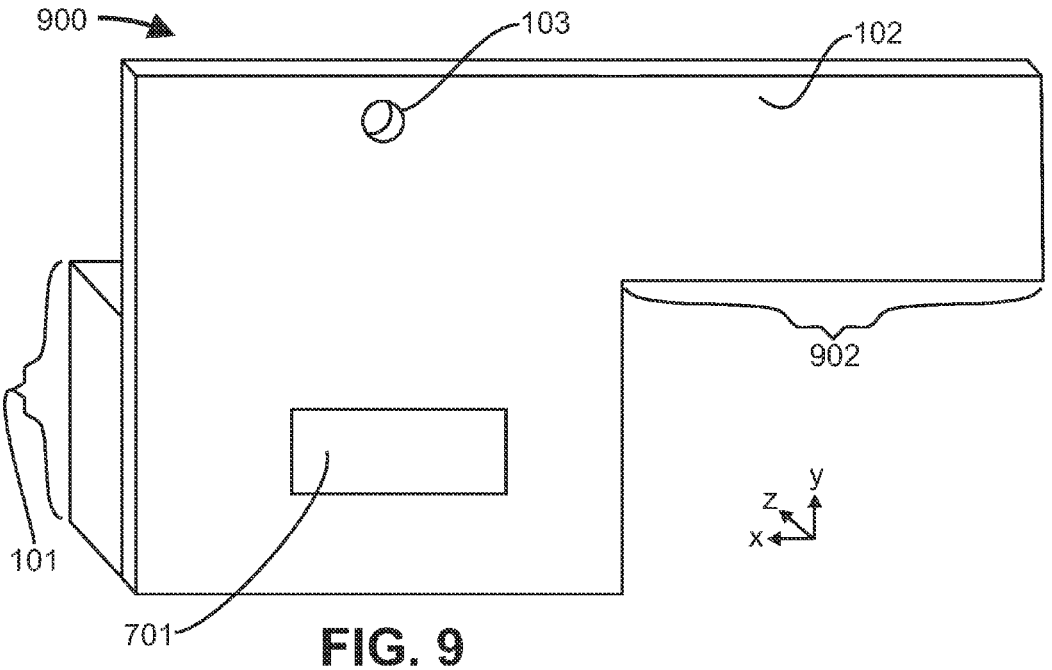
FIG. 9 is a perspective view of the rear of one embodiment of a handbag protection device including a base region, a flap extension with an opening, and a pocket on the rear surface of the base region.

FIG. 9 is a perspective view of the rear of an embodiment of a handbag protection device 900 comprising a base region 101 and a flap extension 102 comprising an opening 103 and a pocket 701 on the rear surface of the base region 101. The flap extension 102 is shaped in a combination of rectangular shapes so that a portion 901 of such flap extension 102 extends in the length direction to wrap, when the device is in use around the front of the flap of the handbag, or one or more sides of the handbag, or the back of the handbag, or around such front, or a first side, or such back, or a second side of the handbag, covering a significant portion of the exterior of such handbag, in addition to the flap extension 102 serving the function of separating the flap of the handbag from the body of the handbag.

Figure 10:
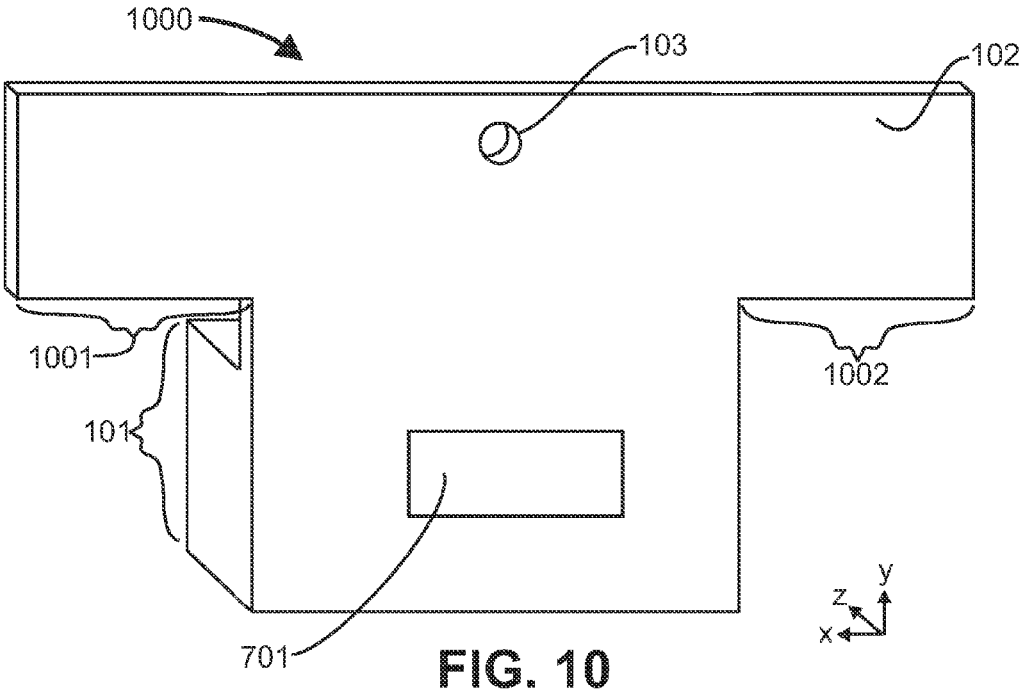
FIG. 10 is a perspective view of the rear of one embodiment of a handbag protection device including a flap extension where the flap extension is shaped in a combination of rectangular shapes such that a first portion and a second portion of the flap extension extend in opposite directions.

FIG. 10 is a perspective view of the rear of an embodiment of a handbag protection device 1000 comprising a base region 101 and a flap extension 102 comprising an opening 103 and a pocket 701 on the rear surface of the base region 101. The flap extension 102 is shaped in a combination of rectangular shapes so that a first portion 1001 of such flap extension 102 extends in the length direction to wrap, when the device is in use around the front of the flap of the handbag, or one or more sides of the handbag, or the back of the handbag, or around such front, or a first side, or such back, or a second side of the handbag, covering a significant portion of the exterior of such handbag, in addition to the flap extension 102 serving the function of separating the flap of the handbag from the body of the handbag and so that a second portion 1002 of such flap extension 102 extends in the length direction opposite the length direction in which such first portion 1001 extends to permit such second portion to wrap, when the device is in use around the front of the flap of the handbag, or one or more sides of the handbag, or the back of the handbag, or around such front, or a first side, or such back, or a second side of the handbag, covering a significant portion of the exterior of such handbag, in addition to the flap extension 102 serving the function of separating the flap of the handbag from the body of the handbag.

Figure 11:
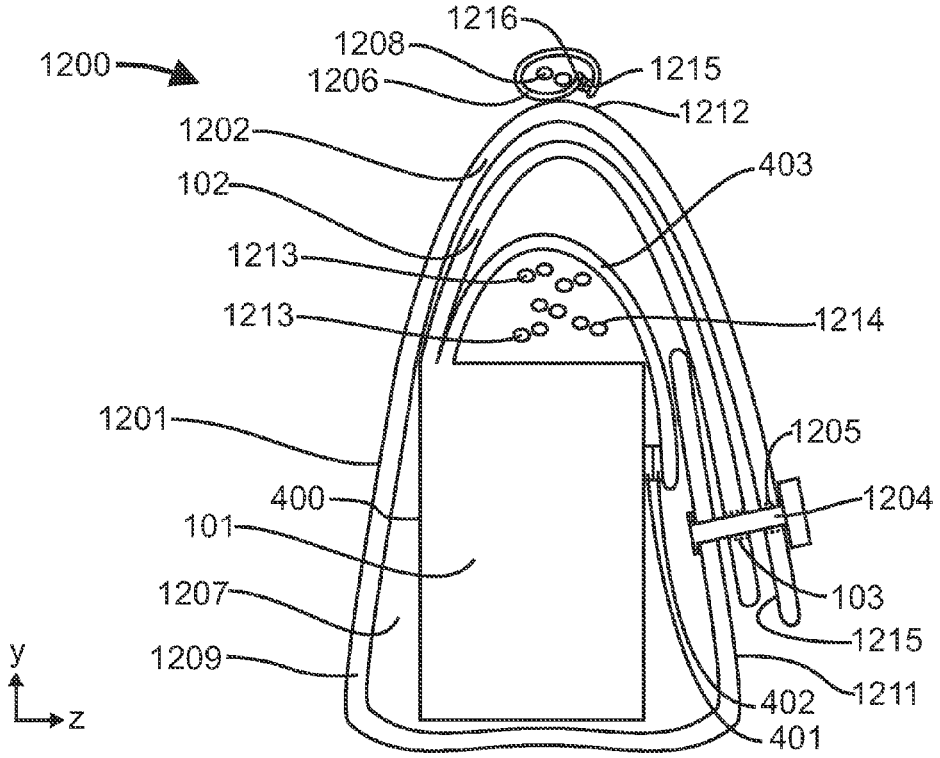
FIG. 11 is a cross-sectional view of the central region of one embodiment of a handbag kit including a handbag and the handbag protection device of FIG. 4.

FIG. 11 is a cross-sectional view of the central region of one embodiment of a handbag kit 1200 including a handbag 1201 and the handbag protection device 400 of FIG. 4 with the base region 101 positioned within a body interior region 1207 of the handbag 1201. In this embodiment, the handbag 1201 includes a handbag flap 1202 extending from a handbag body 1209. The interior of the handbag body 1209 defines the handbag body interior region 1207. The handbag 1201 also includes a clasp 1204 operatively configured to maintain the handbag flap 1202 along the front side 1211 of the handbag 1201 when the handbag flap 1202 is closed and a portion of the clasp 1204 is rotated. The handbag 1201 further includes a chain 1214 partially pulled through holes (not shown) in the handbag flap 1202, leaving exterior chain links 1208 outside the handbag flap 1202 and interior chain links 1213 within the handbag 1201 positioned on the base region 101 of the handbag protection device 400. In this embodiment, the support extension 403 and the flap extension 102 extend toward the same side of the handbag 1201 (the front side 1211), with the support extension 403 extending to the handbag body interior region 1207 and the flap extension 102 extending to the exterior front side 1211 of the handbag 1201. The support extension 403 extends over the interior chain links 1213 within the handbag 1201 and the loop material 401 on the support extension 403 is fastened to the hook material 402 on the base region 101 of the handbag protection device 400. In this embodiment, the support extension 403 prevents the interior chain links 1213 from contacting the inner surfaces of the handbag 1201 to prevent chain impressions or damage to the inner surfaces of the handbag 1201. The flap extension 102 of the handbag protection device 400 extends from the base region 101 and is positioned between the front side 1211 of the handbag 1201 and an inner surface 1215 of the handbag flap 1202. The opening 103 in the flap extension 102 is positioned over the clasp 1204, followed by positioning a handbag flap opening 1205 of the handbag flap 1202 over the clasp 1204. In this embodiment, the flap extension 102 of the handbag protection device 400 protects the front side 1211 of the handbag 1201 and the inner surface 1215 of the handbag flap 1202 from sticking together, transferring color, damaging each other or leaving impressions. By positioning the opening 103 in the flap extension 102 over the clasp 1204, the flap extension 102 remains between the front side 1211 of the handbag 1201 and the inner surface 1215 of the handbag flap 1202 for protection. In this embodiment, the handbag kit 1200 further includes an exterior chain support extension 1206 operatively configured to wrap around the exterior chain links 1208. The exterior chain support extension 1206 is wrapped around the exterior chain links 1208 and includes loop material 1215 and hook material 1216 that are fastened after wrapping to prevent the exterior chain links 1208 from damaging or leaving impressions upon the outer surface 1212 of the handbag flap 1202.

Figure 12:
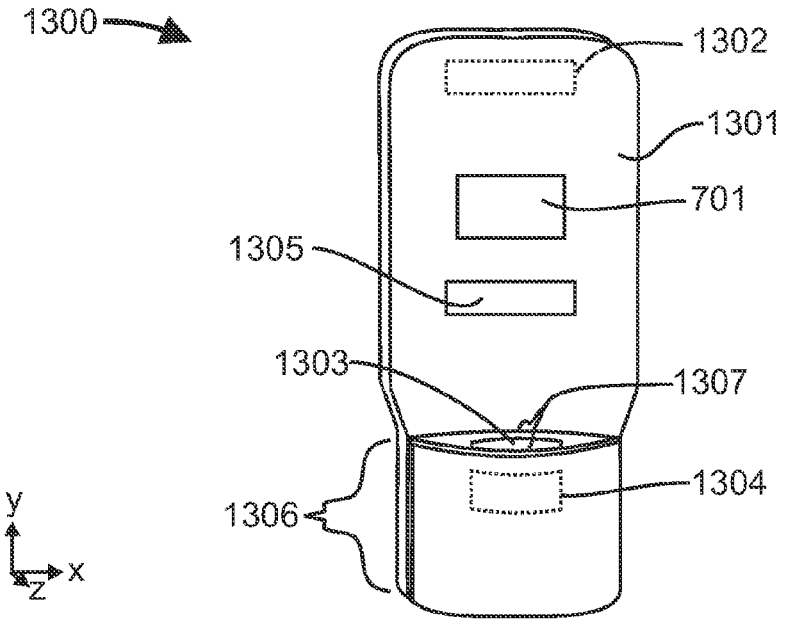
FIG. 12 is a perspective view of one embodiment of a handbag protection device including a flap extension operatively coupled to a base region that includes a support pouch.

FIG. 12 is a perspective view of one embodiment of a handbag protection device 1300 including a flap extension 1301 operatively coupled to a base region 1306 that includes a support pouch 1307. The flap extension 1301 includes a loop material 1305 positioned between the support pouch 1307 and the hook material 1302. The loop material 1305 is positioned on the same side of the handbag protection device 1300 as the opening to the support pouch 1307 and the hook material 1302 is positioned on the opposite side of the handbag protection device 1300 as the opening to the support pouch 1307. The support pouch 1307 includes support pouch hook material 1303 and support pouch loop material 1304 positioned opposite each other such that that can fasten together and substantially close the support pouch 1307 to prevent a handbag chain positioned within the support pouch 1307 from damaging the interior of a handbag. The handbag protection device 1300 further includes a pocket 701, where one may put items such as handbag identification information, receipt, desiccant, deodorizing pouch, or other material or information.

Figure 13:
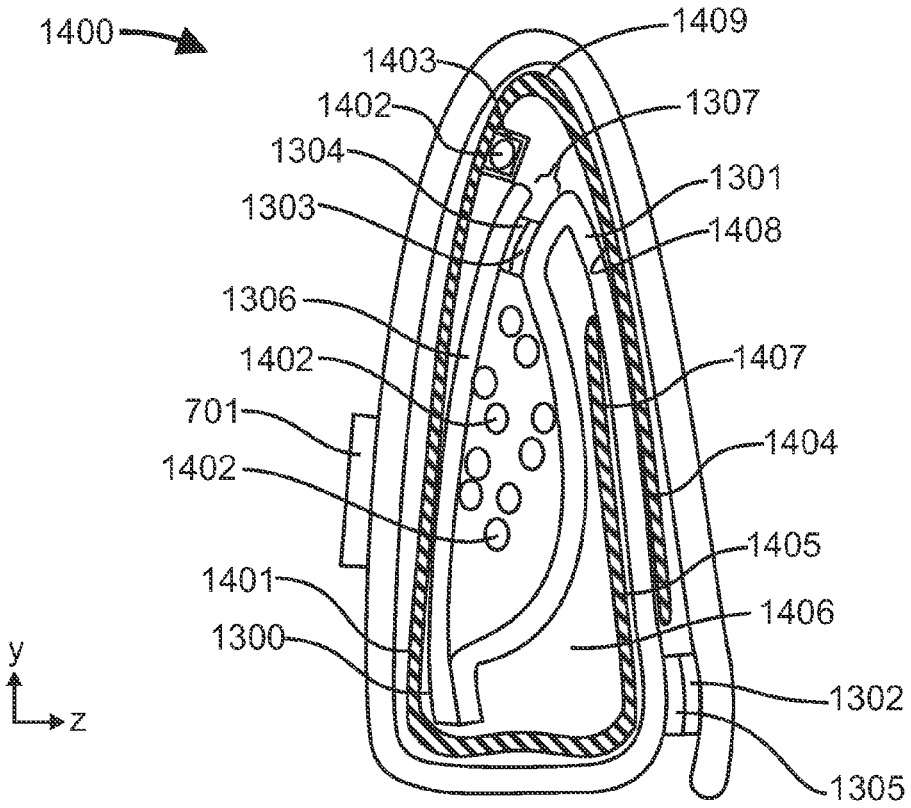
FIG. 13 is a cross-sectional view of the central region of one embodiment of a handbag kit including a handbag and the handbag protection device of FIG. 12.

FIG. 13 is a cross-sectional view of the central region of one embodiment of a handbag kit 1400 including a handbag 1401 and the handbag protection device 1300 of FIG. 12 with the base region 1306 positioned within a body interior region 1406 of the handbag 1401. In this embodiment, the handbag 1401 includes a handbag flap 1404 extending from a handbag body 1405 defining the handbag body interior region 1406. The handbag 1401 includes a chain 1402 positioned within the support pouch 1307 in the base region 1306 of the handbag protection device 1300 and through a chain sleeve 1403 attached to the handbag 1401. The support pouch 1307 is fastened closed using the support pocket hook material 1303 and the support pocket loop material 1304. In this embodiment, the flap extension 1301 wraps around the handbag 1401 by extending between the handbag body 1405 and the handbag flap 1404 and around the handbag 1401 such that the hook material 1302 fastens to the loop material 1305. In this embodiment, the flap extension 1301 of the handbag protection device 1300 protects a front side surface 1407 of the handbag body 1405 and an inner surface 1408 of the handbag flap 1404 from sticking together, transferring color, damaging each other or leaving impressions. The flap extension 1301 also protects the exterior surface 1409 of the handbag 1401 since the flap extension 1301 is wrapped around the handbag 1401 in the plane of the handbag including the depth or height of the handbag (the y-z plane as shown in FIG. 13 where the height and depth of the handbag 1401 are parallel to the y direction). In this embodiment, the length of the flap extension 1301 is longer than the peripheral length of the handbag 1401 (in the y-z plane as shown in FIG. 13). Furthermore, as shown in FIG. 13, the length of the flap extension 1301 is longer than the peripheral length of the handbag 1401 plus the height of the front side surface 1407 of the handbag body 1405. In the embodiment shown in FIG. 13, the flap extension 1301 does not extend across the support pouch 1307 opening when wrapped around the handbag 1401. In another embodiment, the flap extension 1301 extends across the support pouch 1307 when wrapped around the handbag 1401 (essentially flipping the handbag protection device 1300 left to right within the body interior region 1406 of the handbag 1401 from that shown in FIG. 13). In this embodiment, the hook material 1302, the loop material 1305, and the pocket 701, could be positioned on their respective opposite surfaces of the flap extension 1301 to that shown in FIG. 13.

Figure 14:
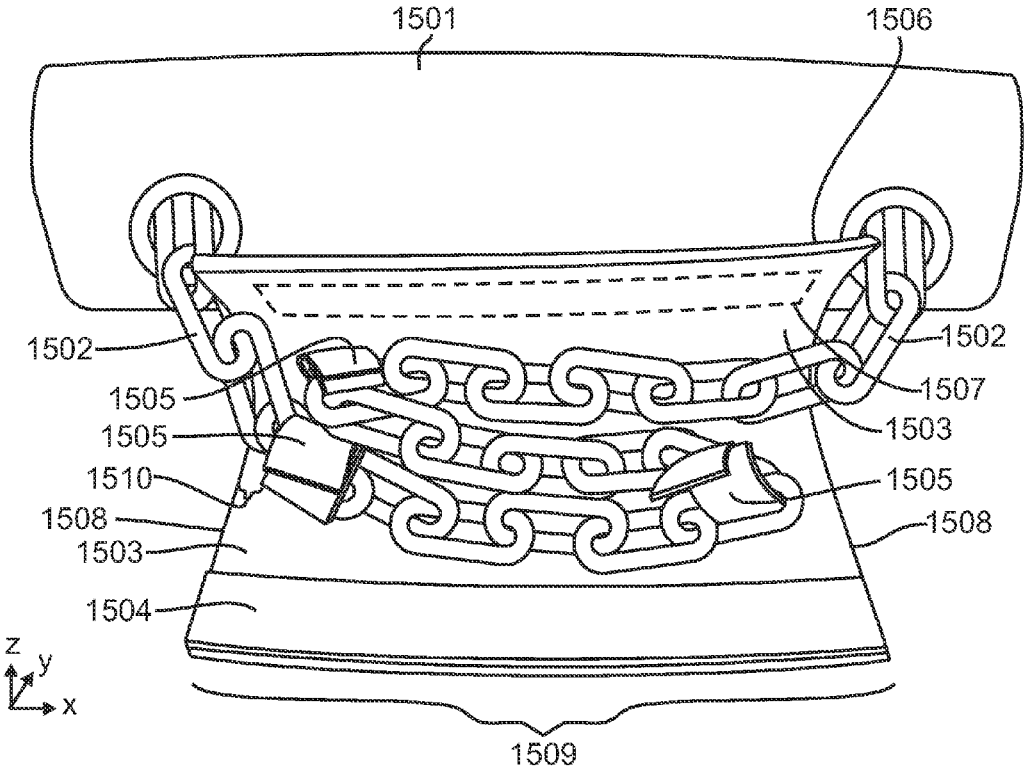
FIG. 14 is a perspective view of one embodiment of a support extension for use with a handbag having chain links outside of the handbag.

FIG. 14 is a perspective view of one embodiment of a support extension 1503 for use with a handbag 1501 having chain links 1502 outside of the handbag 1501. In this embodiment, the support extension 1503 includes a support extension fastener defined by a loop material 1504 and a hook material 1507 (shown as a dotted line looking through the support extension 1503) on opposite sides of the support extension 1503, where the hook material is in this embodiment disposed near but not at an edge 1506 of the support extension 1503. The support extension 1503 extends around the chain links 1502 which are bundled together, and in operation, the support extension fastener is closed by bringing the loop material 1504 to the hook material 1507 by translating one or more ends of the support extension in the y-z plane. The support extension 1503 also includes three handbag extension securing fasteners 1505 that secure the chain links 1502 to the support extension 1503. As shown in FIG. 14, in this embodiment the handbag extension securing extension fasteners 1505 include a strip with hook material on one side and loop material on the opposite side sewn into the support extension 1503. The handbag extension securing fasteners 1505 can be wrapped around the chain links 1502 and onto themselves to close using the hook and loop material. In this embodiment, the handbag extension securing fasteners 1505 are positioned away from the lateral edges 1508 of the support extension 1503 by a handbag extension securing fastener distance 1510, wherein the handbag extension securing fastener distance 1510 is greater than 1% of the transverse width 1509 of the support extension 1503. For ease of viewing the chain links 1502 in FIG. 14 are large, but the chain links could be any size used in handbag manufacture, and the handbag securing extension fasteners 1505 could be wrapped around one or more entire chain links to secure such chain links 1502 to the support extension 1503 or could be wrapped around one or more lengths of chain (each comprised of chain links 1502) to secure such lengths of chain to the support extension 1503.

Device and Examples of Methods of Manufacture or Use

Certain embodiments are illustrated in the following example(s). The following examples are given for the purpose of illustration, but not for limiting the scope or spirit of the invention.

In one embodiment, the device will be used with a handbag that has exactly one attached flap for closure of the handbag that is attached to the top-back of the body of the handbag. The body encloses at least a main carrying compartment and the flap of the handbag, when closed, covers the top of the main carrying compartment and at least a portion of the front of the body of the handbag. Further, the assumed handbag would have a strap made of chain or other material long enough to permit the user to carry the handbag over a shoulder or around the neck and across the body. An example of such a handbag is commonly referred to as a flap handbag. In this embodiment, the base region comprises a white felt material and a flap extension comprising a felt material backed by a broadcloth material that extends from the base region on the top. The base region is filled by single piece foam, and the base region is either a rectangular box shape or a trapezoidal shape (thicker at the bottom and thinner at the top). In one example of this first variant of the handbag protection device, the flap extension is made of white felt and backed by white broadcloth. In one embodiment, a first support extension is made of a felt fabric backed with a broadcloth fabric, rectangular in shape and of sufficient size to wrap around the portion of the handbag chain or handbag strap to be covered and stored inside the handbag, with the hook portion of a hook and loop fastener attached to the flap extension and the mating loop portion attached to the base region. In one embodiment of this first variant, a second support extension, rectangular in shape, is detached from the base region, made of felt backed with broadcloth, and comprises a hook and loop fastening mechanism, with the hook portion affixed along an edge on one side of such second support extension and the mating loop portion positioned and affixed along the opposite edge of the other side of such support extension, enabling such second support extension to wrap around the portion of the handbag chain or handbag strap remaining outside the handbag while the handbag protection device is in use, and enabling such second support extension to fasten to itself using the hook and loop fastener, thereby enclosing or partially enclosing such portion of such handbag chain or such handbag strap. In this example of such second support extension of this first variant, one of the four sides of such second support extension would have along almost its full length the hook portion of a hook and loop fastener closure and the opposite side would have the mating loop portion of the hook and loop fastener.

Felt is chosen for the base region in this example because it is soft, and would not tend to scratch or otherwise abrade the inner portion of the carrying compartment in which it is inserted. Also, white felt, being un-dyed or pigmented, would not tend to transfer color to any materials it may come in contact as opposed to a felt fabric that is dyed or pigmented that could potentially transfer the dye or pigment color to the handbag. Color transfer can be perceived by users to be an undesirable modification to a handbag, even when not visible on the exterior of the handbag. In this example, a single piece of foam substantially or completely fills the fabric base region enclosure volume, thus providing the maximum surface area contact and effective support to the inner walls of the handbag compartment. A rectangular or trapezoidal shape can be sized to fill but not overfill the main carrying compartment. Backing the support extension(s) in broadcloth is particularly important, as the stress on these component(s) from repeated opening and closing of the hook and loop fastener closure (or other fastener) can deform these component(s). If the flap of the handbag is perforated so that a portion of the strap or chain of the handbag can be pulled into the interior of the handbag under the flap of the handbag (or also under the flap extension or also under a support extension), manufacturing the top of the base region with broadcloth also provides additional durability, as the handbag chain or handbag strap would then, in this example of the variant for a device for handbag protection for storage or transport, be pulled into the interior of the handbag as far as practicable without harming the handbag and rested atop the base region. A portion of the handbag chain or handbag strap resting within the interior of the handbag could be gathered or rested atop the base region covered by broadcloth, and such portion of the handbag chain or handbag strap could also be covered by or enclosed or partially enclosed by a flap extension or a support extension. In this embodiment, the flap extension could then wrap or cover the handbag chain or handbag strap, thus reducing the contact of the handbag chain or handbag strap with the interior of the handbag flap, providing further protection of the interior of the handbag from scratching, abrasion, indentation or other damage due to the handbag chain or handbag strap. Additionally, a further advantage of storing much of the handbag chain or handbag strap inside the carrying compartment of the handbag is that the volume required to store the handbag is reduced since a smaller volume of the handbag chain or handbag strap would be stored outside the handbag. With less volume occupied outside of the handbag, the user can store the handbag in an original box from the manufacturer when the box has little or no extra volume outside of the handbag storing region for the handbag chain or handbag strap.

A second variant embodiment of a device for protecting a handbag is for a handbag that has exactly two attached flaps for closure of the handbag, both of which are attached to the top-back of the body of the handbag. In this embodiment, the body of the handbag at least partially encloses at least a main carrying compartment, and a first handbag flap covers the top of the main carrying compartment when closed and covers at least a portion of the front of the body of the handbag. The second flap of the handbag covers the first flap of the handbag and a portion of the front of the body of the handbag when closed. This second variant also assumes that the outer (second) flap of the handbag is perforated to permit the handbag chain to be pulled inside the enclosure of the outer flap of the handbag, but that the first (inner) flap of the handbag is not so perforated. The perforation of the outer handbag flap, but not the inner handbag flap raises the additional challenge of preventing the carrying handbag chain or handbag strap from scratching, abrading, indenting or otherwise damaging the inner handbag flap or the outer handbag flap or both during storage or transport. An example of such a handbag is commonly referred to as a "double flap" handbag. In this second variant example, an embodiment of a handbag protection device is similar to the first variant with two modifications. The first modification is that the depth of the first flap extension (the portion of the flap extension distal from an attachment edge of such flap extension attached to a longer top edge (a length edge) of the base region and extending out and over the front of the handbag) is extended to permit the flap extension to exit the main carrying compartment of the handbag, separate the full length of the inner flap of the handbag from the exterior body of the handbag enclosing the primary carrying compartment of the handbag, wrap around the bottom of the inner flap of the handbag and be inserted between the inner handbag flap and the outer handbag flap to separate those flaps. The second modification takes account of the perforation of the outer handbag flap but not the inner handbag flap. In this embodiment, the device comprises a first support extension comprising a tube of felt attached on one end to the one of the shorter edges of the top of the base region (a width edge) and closed at the other end with a slot near the end of such support extension that is attached to such width edge of the base region, through which slot the handbag chain or handbag strap may be inserted into the cavity within the tube to enclose the handbag chain or handbag strap by the tube and perform the protective function that was performed by the first support extension in the first variant. To store the majority of handbag chain or handbag strap inside the interior carrying compartment of the handbag, atop the top of the base region of the device, the user would pull the handbag chain or handbag strap through the perforations in the outer flap of the handbag, insert the handbag chain or handbag strap through the slot in the enclosing first support extension tube, lay the enclosed handbag chain or handbag strap under the inner flap of the handbag and atop the base region, and use the remaining portion of the first support extension to wrap around the edge of the inner flap of the handbag opposite the edge of the inner flap closest to the end of the first support extension that is attached to the base region, and insert such remainder between the inner flap of the handbag and the outer flap of the handbag (thereby protecting such handbag flaps partially from of the handbag chain or handbag strap). In addition, in this second variant, a second support extension made of felt backed in broadcloth is operatively coupled to the device or unattached to the device and is rectangular in shape as in the first variant. As in the first variant, such second support extension is sufficient in size to wrap around the portion of the handbag chain or handbag strap that rests outside the outer flap of the handbag, where one of the four sides of such second support extension would have along almost its full length the hook portion of a hook and loop fastener closure and the opposite side would have the mating portion of the hook and loop fastener closure.

The reasons for the choices of the materials and other parts of this embodiment of this variant include the reasons that are applicable in the first variant since the desired functionality and material properties are not changed in the second variant. In addition, adding material extending the tubular first support extension in the length direction with a cavity ameliorates a problem with indentation of the inner handbag flap and the outer handbag flap when wrapping the handbag chain or handbag strap around a side edge of the inner flap of the handbag to store the handbag chain or handbag strap in the interior of the handbag. The retention of a detached or detachable second support extension in the form of a rectangular wrap for the handbag chain or handbag strap functions to protect the outer flap of the handbag from indentation that could be caused by the portion of the handbag chain or handbag strap that remains outside the handbag during storage or transport. The extension of the flap extension in the length direction rather than by providing a wing or wings in the width that wrap around the handbag chain or handbag strap where they pass around the edges of the inner flap of the handbag and rather than by providing a detached separator adds ease of use and a more complete enclosure of the handbag strap or handbag chain. Furthermore, this type of support extension can be more convenient to form and attach to the base region.

In both variants, if the handbag flap comprises a clasp, fastener, or other closure mechanism, the flap extension may comprise a cavity, notch, slit or hole to permit the operation of the clasp, fastener, or other closure mechanism.

In both variants, embodiments could contain at least one pocket, in which information about the handbag, such as a purchase receipt or authenticity information could be kept. The second support extension in the form of a rectangular wrap for a handbag chain or handbag strap could also be kept in the pocket or could be attached to the device via an attachment mechanism while the device is not being used with the handbag it is intended to protect.

In one embodiment a method of manufacturing a handbag protection device comprises cutting the cloth components and the foam insert and attaching the cloth components with a sewing apparatus using thread of a compatible color. Other methods and steps for sewing and filling spaces enclosed by fabric with foam or other fill, and ordinary methods of backing with broadcloth, aesthetically appealing finishing methods, and including attaching hook and loop fastener closures, which are known to those skilled in the art, may also be used to manufacture the handbag protection device, including, for example, but without limitation, gluing together component parts, or stapling together component parts.

EQUIVALENTS

Embodiments of the handbag protection device provide an easy-to-use, lightweight device that protects certain components of a handbag that are susceptible to wear or damage during storage or transport. In one embodiment, the handbag protection device is made of inexpensive materials that protect well, and are combined in appropriate configurations to provide increased protection and durability. Use of more expensive or luxurious materials is also possible.

While the above description contains many specificities, these should not be construed as limitations on the scope of the invention, but rather as exemplifications of certain embodiments thereof. In particular, without limiting the generality of the immediately preceding sentence, examples have been described with respect to two variants and it should be recognized that there are many alternative embodiments including alternatives that are made appropriate by a differently designed handbag in which the embodiment would be used. Persons of skill in the art would conceive of many embodiments when presented with the same variants and different variants of handbag design. Many modifications and variations of the device or methods for manufacture or use of the device are possible which would not depart from the scope and spirit of this invention.

Those skilled in the art will recognize, or be able to ascertain using no more than routine experimentation, numerous equivalents to the specific configurations, components, methods and procedures described herein. Such equivalents are considered to be within the scope of the invention. Various substitutions, alterations, and modifications may be made to the invention without departing from the spirit and scope of the invention. Other aspects, advantages, and modifications are within the scope of the invention. This application is intended to cover any adaptations or variations of the specific embodiments discussed herein.

Unless otherwise indicated, all numbers expressing feature sizes, amounts, and physical properties used in the specification and claims are to be understood as being modified by the term "about". Accordingly, unless indicated to the contrary, the numerical parameters set forth in the foregoing specification and attached claims are approximations that can vary depending upon the desired properties sought to be obtained by those skilled in the art utilizing the teachings disclosed herein. Use of the word "or" is not intended to be exclusive unless so stated or unless no other interpretation would be possible or result in a practicable configuration of the invention. Use of the words "including" or "for example" or "such as" or similar words or words of similar intent are not intended to be a limitation on the scope of the invention, but instead are intended to illustrate or describe possible embodiments of the invention without limitation.

What is claimed is:

1. A handbag insert device for inserting into and protecting a handbag having a flap extending from a body of the handbag, an inner surface defining a main carrying compartment of the handbag, and an outer surface opposite the inner surface, the handbag insert device comprising:

a. an enclosed volume base region comprising a material surrounding a fill material, the enclosed volume base region having a first thickness; and b. a flap extension extending from the enclosed volume base region, the flap extension having a second thickness less than the first thickness, wherein when the enclosed volume base region is positioned within the main carrying compartment of the body of the handbag, a firmness, shape, and volume of the fill material sustains a shape of the body of the handbag, and when the flap extension is positioned between the flap of the handbag and the outer surface of the handbag, the flap extension covers a potential region of contact between the flap of the handbag and the outer surface of the handbag.

2. The handbag insert device of claim 1 wherein the flap extension comprises an opening, slit, or notch.

3. The handbag insert device of claim 2 wherein the opening, slit, or notch is positioned in the flap extension such that a portion the opening, slit, or notch extends over or around a clasp of the handbag when the flap extension is positioned between the flap of the handbag and the body of the handbag.

4. The handbag insert device of claim 1 wherein an average depth of the flap extension is greater than two times an average depth of the enclosed volume base region.

5. The handbag insert device of claim 1 wherein an average depth of the flap extension is greater than three times an average depth of the enclosed volume base region and the flap extension is sufficiently long enough to wrap around a front, bottom, back, and top of the handbag.

6. The handbag insert device of claim 1 further comprising a support extension extending from the enclosed volume base region in a first region of the support extension and fastened to the handbag insert device in a second region of the support extension distal from the first region.

7. The handbag insert device of claim 6 wherein the support extension is positioned between a handbag extension and the inner surface or the outer surface of the handbag.

8. The handbag insert device of claim 6 wherein the support extension is temporarily fastened to the base region or itself using a temporary fastener selected from the group: hook and loop fastener, magnetic fastener, reusable tape, zipper, snap closure, resealable zip closure, and button.

9. The handbag insert device of claim 6 wherein the support extension extends across a handbag extension and is fastened to the enclosed volume base region when the enclosed volume base region is disposed within the handbag.

10. The handbag insert device of claim 1 further comprising a support extension having a fastener, wherein the support extension is not continuous with the enclosed volume base region.

11. The handbag insert device of claim 10 wherein the support extension wraps around exterior chain links of the handbag and fastens to itself using the fastener.

12. The handbag insert device of claim 1 wherein the enclosed volume base region comprises a pouch.

13. The handbag insert device of claim 12 wherein the pouch is configured to receive interior chain links of the handbag such that the pouch is positioned between the interior chain links and the interior surface of the handbag.

14. The handbag insert device of claim 1 wherein the enclosed volume base region substantially fills or expands the main carrying compartment of the body of the handbag sufficient to maintain the shape of the handbag during storage of the handbag.

15. The handbag insert device of claim 1 wherein the flap extension comprises a first inner extension surface and opposing outer extension surface, and when the flap extension is positioned between the flap of the handbag and the body of the handbag, the inner extension surface is in contact with the outer surface of the body of the handbag and the outer extension surface of the flap extension is in contact with the inner surface of the flap of the handbag.

16. A handbag insert device for protecting two surfaces of a handbag having a flap, an inner surface defining a main carrying compartment of the handbag, and an outer surface opposite the inner surface, the handbag insert device comprising:

a. a base region comprising a material surrounding an enclosed volume of fill material, the enclosed volume of fill material having a firmness, shape, and volume sufficient to support a shape of the handbag when positioned within the main carrying compartment of the handbag; and b. a flap extension extending from the base region, the flap extension positioned between the flap of the handbag and the outer surface of the handbag to cover a potential region of contact between the flap and the outer surface of the handbag when the base region is inserted into the main carrying compartment of the handbag.

17. A handbag insert device for protecting two surfaces of a handbag having a flap, the handbag insert device comprising:

a. a base region with an enclosed volume of fill material supporting a shape of the handbag when positioned within a carrying compartment of the handbag;

b. a flap extension extending from the base region, the flap extension positioned between the two surfaces of the handbag to reduce or eliminate contact between the two surfaces when the base region is inserted into the carrying compartment of the handbag; and c. a support extension extending from the base region and wrapped around a handbag extension.

18. The handbag insert device of claim 17 wherein the handbag extension is a chain.

19. A handbag insert device for protecting an outer surface of a handbag from an extension of the handbag, the handbag insert device comprising:

a. a body of material at least partially wrapped around the extension of the handbag or at least partially separating the extension of the handbag from the surface of the handbag; and b. an enclosed volume base region comprising a fill material, the enclosed volume base region is attached to the body of material, wherein the body of material is positioned between the outer surface of the handbag and the handbag extension and the enclosed volume base region has a firmness, shape, and volume sufficient to support a shape of the handbag when the enclosed volume base region is inserted into a main carrying compartment of the handbag.

* * * * *